US006078238A

United States Patent [19]

Gerold

[11] Patent Number: 6,078,238

[45] Date of Patent: Jun. 20, 2000

[54] BOLT WITH A MAGNET

[75] Inventor: Peter Gerold, Weilheim, Germany

[73] Assignee: Hilti Aktiengesellschaft, Schaan, Liechtenstein

[21] Appl. No.: 09/084,860

[22] Filed: May 26, 1998

[30] Foreign Application Priority Data

Jun. 7, 1997 [DE] Germany ..... 197 24 134

[51] Int. Cl.[7] ..... H01F 7/02

[52] U.S. Cl. ..... 335/305

[58] Field of Search ..... 335/302–306; 411/383

[56] References Cited

U.S. PATENT DOCUMENTS 2,242,830 5/1941 Lisle ..... 335/305
4,752,759 6/1988 Kazuyuki ..... 335/305
4,763,092 8/1988 Tomita ..... 335/305
4,810,148 3/1989 Aisa et al. ..... 411/383

FOREIGN PATENT DOCUMENTS 9710467 3/1997 China .

*Primary Examiner*—Lincoln Donovan
*Assistant Examiner*—Raymond Barrera
*Attorney, Agent, or Firm*—Brown & Wood, LLP

[57] ABSTRACT

A bolt to be screwed-in into a lubricant-containing housing, including a magnet (4), a head portion (2) having rotation-transmitting surfaces, and a shank portion (3) extending from the head portion (2) and having an outer thread (31) and a recess (32) provided at a free end of the shank portion (3) for form-lockingly receiving the magnet (4) and having a depth (T) measured from the free end of the shank portion (3) and substantially corresponding to an axial width of the magnet (4).

6 Claims, 1 Drawing Sheet

BOLT WITH A MAGNET

BACKGROUND OF THE INVENTION

1. Field of the Invention

The present invention relates to a bolt with a magnet and designed to be screwed-in into a lubricant-containing housing, e.g., of a hand-driven tool, and including a head portion having rotation-transmitting surfaces, and a shank portion extending from the head portion and having an outer thread and a recess for form-locking receiving the magnet.

2. Description of the Prior Art

Hand-driven tools such as, e.g., chisel tools, have a drive and a percussion mechanism. Both the drive and the percussion mechanism have mechanically cooperating metallic components. With the cooperating metallic components, despite lubrication, metallic abrasion or dust is formed which becomes distributed in the lubricant. The metallic abrasion or dust contained in the lubricant reaches the bearings and toothings and leads to excessive wear and premature damage of the ball bearings and toothings.

U.S. Pat. No. 4,810,148 discloses a drain bolt for collecting metallic dust accumulating in a gear housing. The drain bolt has a magnet and is screwed-in into the housing. The bolt has a head portion and a shank portion, with the head portion extending radially beyond the shank portion. The shank portion has an outer thread and a recess formed at the free end of the shank portion. The rotation-transmitting surfaces of the head portion are defined by an outer contour of the head portion having a shape of a hexagon engageable by a wrench.

The magnet projects into the recess and has a portion projecting beyond the free end of the shank portion. The portion of the magnet, which projects beyond the free end of the shank portion, has a length exceeding the entire length of the bolt. Because of its large length, the projecting portion of the magnet extends deep into the inner space of the gear housing and is washed around with the circulating lubricant. The metallic dust distributed in the lubricant is attracted to the magnet and is retained on the free end and on the circumference of the magnet.

The drawback of the drain bolt disclosed in U.S. Pat. No. 4,810,148 consist in that the magnet can hit the thread when the bold is removed, so that a portion of the metal dust, which was collected on the magnet circumference, would be stripped by the thread of the housing and would accumulate there. During a subsequent screw-in of the bolt, the metallic dust or abrasion, which accumulated on the housing thread, can lead to the distortion of the thread connection between the bolt and the housing or would lead to seal leakage in the region of the thread connection. A further drawback of the known drain bolt consists in that the housing, in order to prevent a collision between the elongate portion of the magnet and the movable components of the drive, should have an additional space for receiving the projecting portion of the magnet. This leads to an increased overall dimension of the housing.

Accordingly, an object of the invention is to provide a bolt with a magnet capable of collecting a large amount of metallic abrasion or dust, without the metallic dust being able to be deposited on the housing thread and without the magnet having portions which could collide with the movable parts in the housing.

SUMMARY OF THE INVENTION

These and other objects of the pre sent invention, which will become apparent hereinafter, are achieved by providing at the free end of the shank portion a magnet-receiving recess the depths of which, measured from the free en d of the shank portion, substantially corresponds to the axial width of the magnet. Because of this, th e magnet is so arranged in the bolt that the outer surface of the magnet and the free end surface of the shank portion lie substantially in th e same plane. Because the bolt surrounds the circumference of the magnet, the metallic dust is collected only on the end surface of the magnet facing in the screw-in direction. When the bolt is screwed-out of the housing, no contact between the metallic dust, which is collected on the magnet, and the housing thread takes place. Deposition of the metallic dust on the housing thread is, therefore, prevented.

Because a large amount of the metallic dust is collected and is adhered to the magnet, the magnet should have a large contact surface which is washed with the lubricant the axial width of the magnet and the corresponding depth of the recess can be very small. Preferably, the ratio of the recess depth to the outer diameter of the shank portion is in the range from 0.1:1 to 0.2:1.

A form-locking attachment of the magnet in the recess is advantageously achieved by reducing the recess diameter at the free end of the shank portion so that means is provided which at least partially encompasses the circumferential region of the magnet.

After the bolt according to the present invention is completely removed from the housing, it is necessary to separate the magnet from the bolt. In order to effect this separation with simple means, advantageously, at least one tab is provided in the circumferential region of the recess which extends radially inward and opens toward the free end of the shank portion. The magnet is separated, e.g., with a screw driver which is inserted into the tab opening and, upon pivoting, is supported against a surface of the bolt extending to the free end of the shank portion, on one hand, and, the other hand, engages the magnet sidewise and extracts it from the recess. The magnet can, e.g., be provided with a radial dent into which the tip of the screw driver can form-lockingly engage. The recess can also be so formed that the screw driver can engage the magnet from the rear.

Because the magnet, when being extracted from the recess with a screw driver, can tilt and become, therefore, jammed, advantageously several tabs are provided along the recess circumference, which are uniformly distributed thereover. In this way, it is possible to extract the magnet from the recess with, e.g., two screw drivers engaging the magnet at opposite points.

Advantageously, the screw is formed of a plastic material. The screw formed of a plastic material has a small weight which result in the reduced weight of the entire tool.

For economical reasons, the magnet, which is form-locking arranged in the bolt, is advantageously extrusion-coated with a plastic material.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
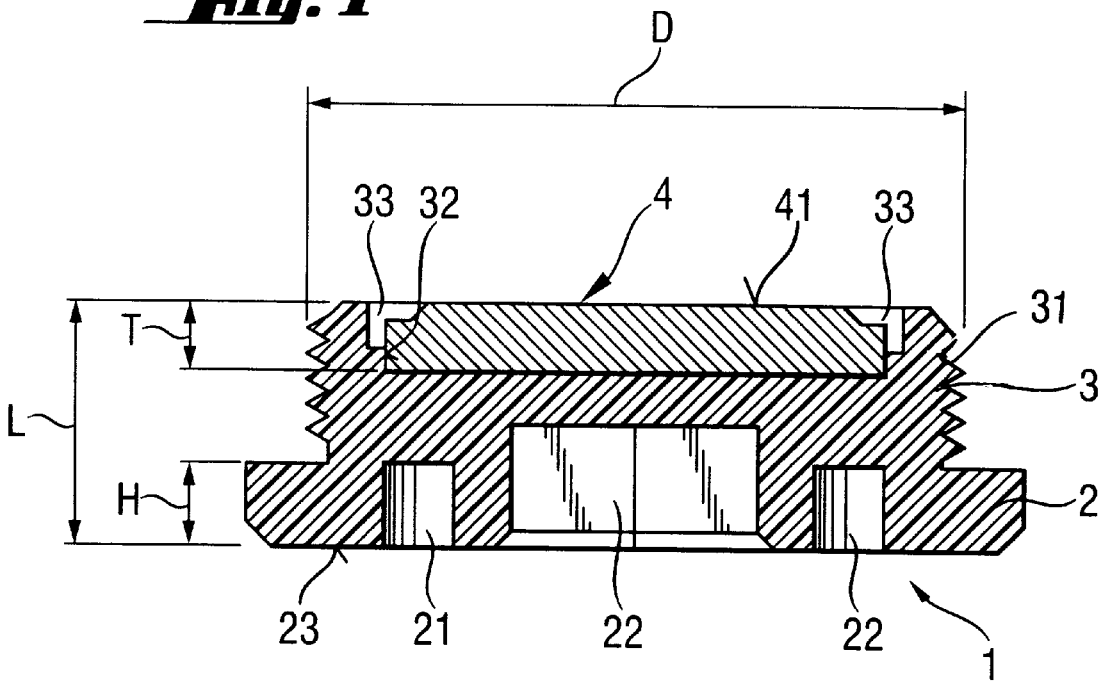
FIG. 1 shows a cross-sectional view of a bolt with a magnet according to the present invention.
Figure 2:
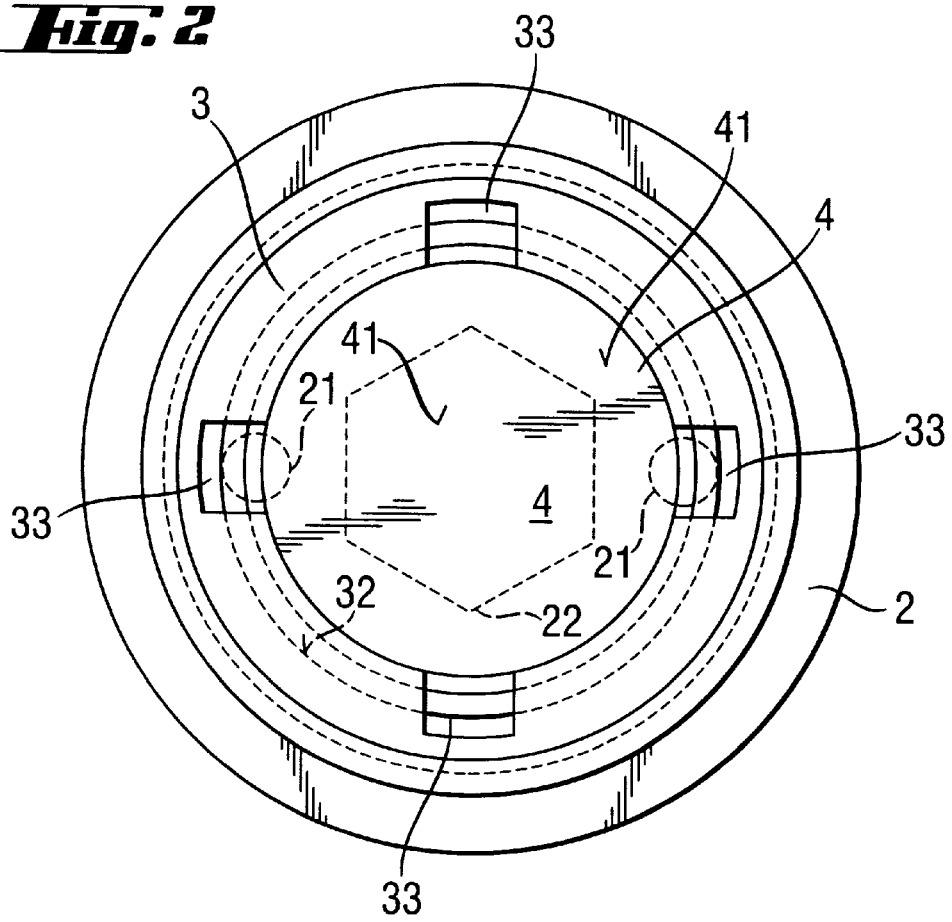
FIG. 2 shows a plan view of the bolt shown in FIG. 1.

A bolt 1 according to the present invention, which is shown in FIGS. 1 and 2, has a magnet 4 and consists of a head portion 2 and a shank portion 3 having a diameter D. The head portion 2 has an annular outer contour and projects radially beyond an outer contour of the shank portion 3 of the bolt 1 and which is defined by an outer thread 31. The axial height H of the head portion 2 substantially corresponds to one third of the entire length L of the bolt 1.

The end surface 23 of the head portion 2 of the bolt 1 has a plurality of hollows 21, 22 which can be engaged with a screw driver (not shown). The hollows 21, 22 open into the end surface 23 of the head portion 2 and extend up to a region of the shank portion 2. The hollow 22 is formed in the center of the bolt 1 and has a shape of a hexagon socket.

The central hollow 22 extends in the axial direction substantially by half of the entire length L of the bolt 1. The two, diametrically opposite hollows 21 are formed as blind holes.

The shank portion 3 has a recess 32 which is open at the free end of the shank portion 3. The axial depth T of the recess 32 correspond substantially to one third of the entire length L of the bolt 1. The ratio between the depth T of the recess 32 and the outer diameter of the shank portion 3 is in the range between 0.1:1 and 0.2:1.

The magnet 4 is secured in the recess 32. At that, the outer diameter of the magnet 4 substantially corresponds to the inner diameter of the recess 32. The outer diameter of the magnet 4 is stepwise reduced in the screw-in direction, with the end face 41 of the reduced diameter portion of the magnet 4 lying in the plane of the free end surface of the shank portion 3. The shank portion 3 tapers toward its free end surface.

The inner diameter of the recess 32 has a reduced diameter portion at the free end of the shank portion 3 of the bolt 1. The reduced diameter portion of the recess 32 is defined by tabs 33 projecting inward from the wall of the recess 32 which engage the shoulder of the magnet 4 defining the reduced diameter portion of the magnet 4, from beneath. As a result, the magnet 4 is form-lockingly retained in the recess 32.

In the mouth of the recess 32, there are provided four tabs 33 uniformly distributed over the perimeter of the recess 32. The tabs 33 occupy a portion of the circumference of the recess 32.

Through the present invention was shown and described with references to the preferred embodiment, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A bolt to be screwed-in into a lubricant-containing housing, comprising a magnet (4); a head portion (2) having rotation-transmitting surfaces; and a shank portion (3) extending from the head portion (2) and having an outer thread (31) and a recess (32) provided at a free end of the shank portion (3) for form-lockingly receiving the magnet (4) and having a depth (T) measured from the free end of the shank portion (3) and corresponding to an axial width of the magnet (4)

wherein a ratio between the depth (T) of the recess (32) of the shank portion (3) and an outer diameter (D) of the shank portion (3) is in a range from 0.1:1 to 0.2:1.

2. A bolt to be screwed-in into a lubricant-containing housing, comprising a magnet (4); a head portion (2) having rotation-transmitting surfaces; and a shank portion (3) extending from the head portion (2) and having an outer thread (31) and a recess (32) provided at a free end of the shank portion (3) for form-lockingly receiving the magnet (4) and having a depth (T) measured from the free end of the shank portion (3) and corresponding to an axial width of the magnet (4), wherein the recess (32) has a reduced diameter portion at the free end of the shank portion (3).

3. A bolt to be screwed-in into a lubricant-containing housing, comprising a magnet (4); a head portion (2) having rotation-transmitting surfaces; a shank portion (3) extending from the head portion (2) and having an outer thread (31) and a recess (32) provided at a free end of the shank portion (3) for form-lockingly receiving the magnet (4) and having a depth (T) measured from the free end of the shank portion (3) and corresponding to an axial width of the magnet (4), and at least one tab (33) provided in a circumference region of the recess (32) and projecting radially inward for form-lockingly engaging the magnet (4), the at least one tab (33) opening toward the free end of the shank portion (3).

4. A bolt according to claim 3, comprising a plurality of magnet (4) form-lockingly engaging tabs (33) uniformly distributed over the circumference of the recess (32).

5. A bolt according to claim 3, wherein the bolt is formed of a plastic material.

6. A bolt according to claim 5, wherein the magnet (4) is partially extrusion-coated with a plastic material.

* * * * *